US006159324A

United States Patent [19]

Watters et al.

[11] Patent Number: 6,159,324

[45] Date of Patent: Dec. 12, 2000

[54] PROCESS FOR MANUFACTURING PROTECTIVE HELMETS

[75] Inventors: Robert D. Watters, Ottawa; John C. Tutton, North Gower; Aldo F. Balatti, Greely; Mark A. Fletcher, Ottawa; Nicholas Shewchenko, Chelsea; Timothy Douglas Bayne, Ottawa; Christopher Robert Patrick Withnall, Nepean, all of Canada

[73] Assignee: Sportscope, Chicago, Ill.

[21] Appl. No.: 09/263,711

[22] Filed: Mar. 5, 1999

[51] Int. Cl.[7] ..... A42B 3/00; A42B 3/32

[52] U.S. Cl. ..... 156/242; 264/297.2; 264/328.1; 264/259; 264/511; 264/553; 2/414; 2/417; 2/421; 2/425

[58] Field of Search ..... 264/297.2, 328.1, 264/259, 500, 511, 553; 156/60, 242; 2/414, 417, 421, 425

[56] References Cited

U.S. PATENT DOCUMENTS

| | | |
|---|---|---|
| Re. 35,193 | 4/1996 | Shifrin . |
| D. 293,496 | 12/1987 | Gentes . |
| D. 316,165 | 4/1991 | Gentes et al. . |
| D. 335,195 | 4/1993 | Choe et al. . |
| D. 339,427 | 9/1993 | Gentes . |
| D. 347,300 | 5/1994 | Gentes . |
| D. 347,711 | 6/1994 | Egger . |
| D. 348,392 | 7/1994 | Tanner . |
| D. 348,545 | 7/1994 | Egger . |
| D. 348,750 | 7/1994 | Egger . |
| D. 352,803 | 11/1994 | Sasaki et al. . |
| D. 362,084 | 9/1995 | Egger . |
| D. 371,224 | 6/1996 | Carlson et al. . |
| D. 380,870 | 7/1997 | Szabados . |
| D. 383,875 | 9/1997 | Morgan . |
| D. 387,501 | 12/1997 | Cheng . |
| D. 407,860 | 4/1999 | Cox et al. . |
| 1,373,446 | 5/1921 | Pierce . |

(List continued on next page.)

FOREIGN PATENT DOCUMENTS

| | | |
|---|---|---|
| 1147501 | 6/1983 | Canada . |
| 1122275 | 5/1996 | China . |
| 113152 | 9/1996 | China . |
| 0074658A2 | 9/1982 | European Pat. Off. . |
| 0150876A2 | 1/1985 | European Pat. Off. . |
| 0259516A1 | 9/1986 | European Pat. Off. . |
| 0280042A1 | 1/1987 | European Pat. Off. . |
| 0815754A1 | 6/1996 | European Pat. Off. . |
| 0743022A2 | 11/1996 | European Pat. Off. . |
| 0792592A1 | 2/1997 | European Pat. Off. . |
| 2490466 | 9/1980 | France . |
| 3116037A1 | 4/1981 | Germany . |
| 4009036A1 | 3/1990 | Germany . |
| 61-215014 | 3/1985 | Japan . |
| 8003048 | 7/1981 | Sweden . |
| 1387966A1 | 10/1984 | U.S.S.R. . |
| 1424788A1 | 2/1987 | U.S.S.R. . |
| 2098852 | 3/1982 | United Kingdom . |
| 2220556 | 7/1990 | United Kingdom . |
| WO98/06285 | 2/1998 | WIPO . |
| WO98/23174 | 6/1998 | WIPO . |
| WO99/08557 | 2/1999 | WIPO . |

OTHER PUBLICATIONS

Team Wendy—Our Helmets Web Page (circa Jan. 1999).

*Primary Examiner*—Sam Chuan Yao
*Attorney, Agent, or Firm*—Michael D. Rechtin; Foley & Lardner

[57] ABSTRACT

A new process for making headgear. The process comprises the step of insert molding an armature into helmet segments to produce a protective helmet having superior characteristics. The process also comprises the step of strategically locating a retention system on the helmet to provide increased stabilization of the helmet on the wearer's head. The process further comprises the step of attaching an improved strap guide to the helmet. One embodiment of this invention is a process for making an insert-molded helmet that can be converted into a pouch. Another embodiment of this invention is a process for making a helmet that includes a protrusion at the back of a helmet suitable for a compartment.

25 Claims, 6 Drawing Sheets

U.S. PATENT DOCUMENTS

| | | |
|---|---|---|
| 1,559,252 | 10/1925 | Hartman . |
| 1,912,551 | 6/1933 | Strauss . |
| 2,181,180 | 11/1939 | Feige . |
| 2,381,524 | 8/1945 | Taylor . |
| 2,710,972 | 6/1955 | Radnofsky . |
| 2,861,274 | 11/1958 | Stuart et al. . |
| 3,082,427 | 3/1963 | Zbikowski . |
| 3,082,428 | 3/1963 | Zbikowski . |
| 3,087,166 | 4/1963 | Howard . |
| 3,155,981 | 11/1964 | McKissick et al. . |
| 3,197,784 | 8/1965 | Carlisle . |
| 3,204,251 | 9/1965 | Child . |
| 3,529,306 | 9/1970 | Thorne . |
| 3,765,031 | 10/1973 | Beresic . |
| 3,934,271 | 1/1976 | Rhee . |
| 3,991,422 | 11/1976 | Saotome . |
| 3,992,722 | 11/1976 | Rhee . |
| 4,023,209 | 5/1977 | Frieder, Jr. et al. . |
| 4,044,400 | 8/1977 | Lewicki et al. . |
| 4,058,854 | 11/1977 | Rhee . |
| 4,100,625 | 7/1978 | Tung . |
| 4,185,331 | 1/1980 | Nomiyama . |
| 4,274,271 | 6/1981 | Todd et al. . |
| 4,286,339 | 9/1981 | Coombs . |
| 4,404,690 | 9/1983 | Farquharson . |
| 4,434,514 | 3/1984 | Sundahl et al. . |
| 4,443,891 | 4/1984 | Blomgren et al. . |
| 4,461,044 | 7/1984 | Reiterman et al. . |
| 4,477,929 | 10/1984 | Mattsson . |
| 4,586,200 | 5/1986 | Poon . |
| 4,607,397 | 8/1986 | Laxo . |
| 4,665,569 | 5/1987 | Santini . |
| 4,724,549 | 2/1988 | Herder et al. . |
| 4,744,107 | 5/1988 | Fohl . |
| 4,766,616 | 8/1988 | Donahue . |
| 4,776,324 | 10/1988 | Clarren . |
| 4,808,469 | 2/1989 | Hiles . |
| 4,827,537 | 5/1989 | Villa . |
| 4,843,642 | 7/1989 | Brower . |
| 4,845,786 | 7/1989 | Chiarella . |
| 4,897,888 | 2/1990 | Broersma et al. . |
| 4,901,373 | 2/1990 | Broersma . |
| 4,903,348 | 2/1990 | Broersma . |
| 4,903,350 | 2/1990 | Gentes et al. . |
| 4,912,777 | 4/1990 | Gasbarro . |
| 4,972,527 | 11/1990 | Wallace . |
| 4,993,082 | 2/1991 | Gentes et al. . |
| 4,995,117 | 2/1991 | Mirage . |
| 5,005,220 | 4/1991 | Gaiatto et al. . |
| 5,007,141 | 4/1991 | Gentes . |
| 5,012,533 | 5/1991 | Raffler . |
| 5,023,958 | 6/1991 | Rotzin . |
| 5,083,321 | 1/1992 | Davidsson . |
| 5,088,130 | 2/1992 | Chiarella . |
| 5,088,633 | 2/1992 | Cunard et al. . |
| 5,097,538 | 3/1992 | Fealing . |
| 5,099,523 | 3/1992 | Broersma . |
| 5,117,662 | 6/1992 | Holmes . |
| 5,119,516 | 6/1992 | Broersma . |
| 5,123,121 | 6/1992 | Broersma . |
| 5,139,017 | 8/1992 | McCloud . |
| 5,148,950 | 9/1992 | Hosaka . |
| 5,151,944 | 9/1992 | Yamamura . |
| 5,181,279 | 1/1993 | Ross . |
| 5,231,704 | 8/1993 | Hildenbrand . |
| 5,267,767 | 12/1993 | Farrow . |
| 5,269,025 | 12/1993 | Broersma . |
| 5,271,102 | 12/1993 | Feuling . |
| 5,271,103 | 12/1993 | Darnell . |
| 5,272,773 | 12/1993 | Kamata . |
| 5,294,914 | 3/1994 | Dallas . |
| 5,327,588 | 7/1994 | Gerneau . |
| 5,329,641 | 7/1994 | Kalhous . |
| 5,333,329 | 8/1994 | Hong . |
| 5,351,341 | 10/1994 | Broersma . |
| 5,353,008 | 10/1994 | Eikenberry et al. . |
| 5,365,615 | 11/1994 | Piszkin . |
| 5,376,318 | 12/1994 | Ho . |
| 5,381,560 | 1/1995 | Halstead . |
| 5,403,021 | 4/1995 | Shifrin . |
| 5,424,021 | 6/1995 | Nakade et al. . |
| 5,426,792 | 6/1995 | Murasko . |
| 5,438,702 | 8/1995 | Jackson . |
| 5,450,631 | 9/1995 | Egger . |
| 5,465,421 | 11/1995 | McCormick et al. . |
| 5,467,485 | 11/1995 | Casartelli . |
| 5,469,583 | 11/1995 | Akeley et al. . |
| 5,477,563 | 12/1995 | Gentes et al. . |
| 5,479,325 | 12/1995 | Chien . |
| 5,481,759 | 1/1996 | Rinaldi . |
| 5,481,762 | 1/1996 | Gentes et al. . |
| 5,493,736 | 2/1996 | Allison . |
| 5,508,900 | 4/1996 | Norman . |
| 5,515,546 | 5/1996 | Shifrin . |
| 5,517,698 | 5/1996 | Nault et al. . |
| 5,519,895 | 5/1996 | Barnes, Jr. . |
| 5,544,027 | 8/1996 | Orsano . |
| 5,551,094 | 9/1996 | Navone . |
| 5,555,570 | 9/1996 | Bay, Jr. . |
| 5,555,584 | 9/1996 | Moore, III et al. . |
| 5,557,807 | 9/1996 | Hujar et al. . |
| 5,559,680 | 9/1996 | Tabanera . |
| 5,564,129 | 10/1996 | Ball et al. . |
| 5,572,749 | 11/1996 | Ogden . |
| 5,581,819 | 12/1996 | Garneau . |
| 5,592,936 | 1/1997 | Thomas, Jr. et al. . |
| 5,608,918 | 3/1997 | Salvaggio . |
| 5,615,410 | 3/1997 | DeMars . |
| 5,615,419 | 4/1997 | Williams . |
| 5,619,756 | 4/1997 | Garneau . |
| 5,621,923 | 4/1997 | Tapocik . |
| 5,651,145 | 7/1997 | Egger . |
| 5,651,848 | 7/1997 | Cohee et al. . |
| 5,659,900 | 8/1997 | Arney et al. . |
| 5,661,854 | 9/1997 | March, II . |
| 5,664,444 | 9/1997 | Schaan . |
| 5,666,700 | 9/1997 | Anscher et al. . |
| 5,669,079 | 9/1997 | Morgan . |
| 5,675,843 | 10/1997 | Grim et al. . |
| 5,685,020 | 11/1997 | Powell et al. . |
| 5,687,426 | 11/1997 | Sperber . |
| 5,699,561 | 12/1997 | Broersma . |
| 5,701,609 | 12/1997 | Bridges . |
| 5,718,004 | 2/1998 | Broersma et al. . |
| 5,729,877 | 3/1998 | Kong et al. . |
| 5,732,414 | 3/1998 | Monica . |
| 5,737,777 | 4/1998 | Hilleary . |
| 5,745,923 | 5/1998 | Katz . |
| 5,745,924 | 5/1998 | Egger . |
| 5,746,442 | 5/1998 | Hoyaukin . |
| 5,753,061 | 5/1998 | Rudy . |
| 5,768,714 | 6/1998 | Bowhey . |
| 5,774,901 | 7/1998 | Minami . |
| 5,794,272 | 8/1998 | Workman et al. . |
| 5,809,578 | 9/1998 | Williams . |
| 5,813,055 | 9/1998 | Egger . |
| 5,815,846 | 10/1998 | Calonge . |
| 5,833,796 | 11/1998 | Matich . |
| 5,839,121 | 11/1998 | Morales . |
| 5,862,528 | 1/1999 | Saijo et al. . |
| 5,867,840 | 2/1999 | Hirosawa et al. . |
| 5,871,271 | 2/1999 | Chien . |
| 5,874,151 | 2/1999 | Cohee et al. . |
| 5,887,288 | 3/1999 | Arney et al. . |
| 5,896,587 | 4/1999 | Gentry . |

PROCESS FOR MANUFACTURING PROTECTIVE HELMETS

This invention is related to a co-pending U.S. patent application Ser. No. 09/160,655, filed Sep. 25, 1998 entitled "Insert-Molded Helmet".

FIELD OF THE INVENTION

This invention is directed to a new process for making headgear. More particularly, the invention is directed to a process for making an improved protective helmet by integrally molding segments of the helmet. The process includes the step of insert molding an armature into helmet segments to produce a protective helmet having superior characteristics. One embodiment of this invention comprises the step of attaching an improved strap guide to an insert-molded helmet.

BACKGROUND OF THE INVENTION

Protective helmets and other protective headgear have evolved over the years. It is not uncommon for individuals to wear protective headgear when they are, for example, riding bicycles, riding horses, roller-blading, playing football, playing baseball, playing hockey, skiing and skating, as well as for other general safety purposes. Conventional headgear is often stiff and thick, and made of impact-resistant materials that encase the skull of the wearer. While it is true that conventional headgear does to a certain degree protect the head of the wearer, it is typically stiff and thick and has many disadvantages.

Conventional headgear is, for instance, often very cumbersome. When removed from the head, such headgear is difficult to carry, particularly because of its size, shape and weight. Additionally, conventional headgear is uncomfortable to wear, often resulting in pain around the head and causing excessive perspiration around various parts of the head. One of the most serious flaws in typical headgear is its inability to fit the head of the user properly. Upon purchasing conventional protective headgear, the user often has to "force fit" the headgear to his or her head. The force fitting is achieved, most often, by inserting sizing pads into pockets around the internal brim of the headgear. While the use of sizing pads can result in somewhat better fitting protective headgear, the fit obtained with respect to the head of the user is not usually complete or tight and is subject to the uncertain skill of the person using the sizing pads. This means that portions of the protective headgear and protective headgear in combination with sizing pads do not come into direct contact with the head of the user, and therefore, an imperfect fit arises in, for example, the form of gaps between the head of the user and the headgear.

As a result of such an imperfect fit, it is believed that the head of the user can be subjected to "secondary impact" forces. This means that in the event of an accident or fall, the protective headgear will make contact with, for example, another bicycle rider or the ground or other obstacle, and the head of the user will come into contact (secondary impact) with the internal portions of the helmet. Such secondary impact is believed to diminish the protective capabilities of conventional helmets.

In addition to secondary impact, it is believed that conventional protective headgear which is force-fitted to the head of a user often fails to effectively dissipate loads created from contact. The failure to dissipate loads effectively can also contribute to serious head injuries.

It is of increasing interest to produce protective headgear that is comfortable to wear and able to effectively minimize the risk of head injuries. This invention, therefore, is directed in part to a process for making superior protective helmets. The protective helmets made by the process of this invention are, among other things, comfortable, not cumbersome, and able to form to the head of the wearer to thereby minimize the risk of injury during accidents or falls.

U.S. Pat. No. 5,515,546 assigned to the assignee of the instant application describes a foldable, padded helmet. Also, U.S. Pat. No. Re 35,193, assigned to the instant assignee, describes a pouch-forming protective helmet for bicyclists. These patents of the assignee are herein incorporated by reference.

While some of the prior art describe processes for making flexible helmets, such flexible helmets comprise a plurality of individual connecting parts assembled in a structure with substantial defects and may not conform to the wearer's head. This plurality of individual connecting parts complicates the manufacturing process and does not generally provide necessary uniformity in hinging and sizing.

It is therefore an object of the present invention to provide a novel process for making headgear.

It is another object of this invention to provide a novel process for making an improved protective helmet by integrally molding segments of the helmet.

It is another object of this invention to provide a novel process for making an improved protective helmet comprising a plurality of segmented panels and having pivot axes substantially between horizontal and vertical, thereby allowing flexing of the panels around the wearer's head.

It is another object of this invention to provide a novel process for making an improved protective helmet comprising six segmented panels arranged in a particularly advantageous way.

It is another object of this invention to provide a novel process for making an improved protective helmet comprising a plurality of segmented panels that conform to the wearer's head, with the absence of a fitting panel in front.

It is another object of this invention to provide a novel process for making an improved protective helmet comprising a plurality of segmented panels that conform laterally about the wearer's head.

It is another object of this invention to provide a novel process for making an improved protective helmet having at least two segmented panels on each side of the wearer's head.

It is another object of this invention to provide a novel process for making an improved protective helmet comprising five segmented panels that conform laterally about the wearer's head and further including a top panel.

It is another object of this invention to provide a novel process for making an improved protective helmet wherein a top panel straddles two side segmented panels disposed on each side of the wearer's head.

It is another object of this invention to provide a novel process for making an improved protective helmet wherein a top panel overlaps gaps between the top panel and peripheral panels, thereby further protecting the wearer's head from leakage of substances onto the wearer's head.

It is another object of this invention to provide a novel process for making an improved protective helmet wherein gaps between segmented panels are staggered to prevent unwanted folding or other instability or lack of integrity of fit of the helmet.

It is another object of this invention to provide a novel process for making an improved protective helmet having two segments disposed from the wearer's forehead to the wearer's neck.

It is another object of this invention to provide a novel process for making an improved protective helmet by insert molding an armature into helmet segments to produce a protective helmet having superior characteristics.

It is another object of this invention to provide a novel process for making an improved protective helmet by insert molding a one-piece armature into helmet segments to produce uniformity in hinging and sizing.

It is another object of this invention to provide a novel process for making an improved protective helmet by insert molding an armature into helmet segments and attaching reinforcement limiter tabs between segmented panels of the helmet.

It is another object of this invention to provide a novel process for making an improved protective helmet by insert molding an armature into segmented, peripheral helmet panels.

It is another object of this invention to provide a novel process for making an improved protective helmet by insert molding an armature into segmented, peripheral helmet panels wherein the armature is discontinuous at the top of the helmet.

It is another object of this invention to provide a novel process for making an improved protective helmet by insert molding an armature into segmented, peripheral helmet panels wherein the armature is non-integrally connected to a top panel or panels of the helmet.

It is another object of this invention to provide a novel process for making an improved protective helmet by insert molding an armature into peripheral helmet panels wherein a top panel is connected to the peripheral panels with loops formed by the armature.

It is another object of this invention to provide a novel process for making an improved protective helmet by insert molding an armature into peripheral helmet panels and also insert molding tabs protruding from the armature into a top panel or panels of the helmet.

It is another object of this invention to provide a novel process for making an improved protective helmet by insert molding an armature into peripheral helmet panels, insert-molding a separate armature into a top panel or panels, and connecting the two armatures as a means of securing the top panel or panels to the peripheral panels.

It is another object of this invention to provide a novel process for making an improved protective helmet by attaching a retention system to the helmet in a strategic location for improved stabilization.

It is another object of this invention to provide a novel process for making an improved protective helmet by attaching a retention system to integrally molded segments of the helmet in a strategic location such that the retention system brings the panels close to the wearer's head thereby conforming to the size and shape of the wearer's head.

It is another object of this invention to provide a novel process for making an improved protective helmet by attaching a retention system to at least one of the following: the front of the top segment of the helmet, the central area of the top segment of the helmet, the back of the top segment of the helmet, the peripheral panels of the helmet, the exterior surface of the helmet, and to an armature, wherein the armature is insert-molded within the helmet.

It is another object of this invention to provide a novel process for making an improved protective helmet by insert molding an armature into segmented panels of the helmet and attaching a retention system to protrusions of the armature, wherein the retention system is attached to the armature either before or after insert molding the armature into the segmented panels.

It is another object of this invention to provide a novel process for making an improved protective helmet with an improved strap guide.

It is another object of this invention to provide a novel process for making an improved protective helmet that can also function as a pouch for holding small objects and can be attached about the waist or hung over the shoulder when not worn on the wearer's head.

It is yet a further object of this invention to provide a novel process for making an improved protective helmet with a protrusion extending from the back of the helmet in which a storage compartment can be formed.

Other objects and advantages of the invention will become apparent by review of the detailed description of preferred embodiments.

SUMMARY OF THE INVENTION

In a first aspect, this invention is directed to a process for making an improved protective helmet by insert molding an armature into the protective helmet.

In a second aspect, this invention is directed to a process for making an improved protective helmet by insert-molding an armature into a bottom portion and a top portion of the protective helmet, in no particular order.

In a third aspect, this invention is directed to a process for making an improved protective helmet by insert-molding an armature into a bottom portion of the protective helmet.

In a fourth aspect, this invention is directed to a process for making an improved protective helmet by insert-molding an armature into a top portion of the protective helmet.

In a fifth aspect, this invention is directed to a process for making an improved protective helmet by molding recesses into a liner of the helmet for inserting an improved strap guide into a locking mechanism provided by the recesses.

The above described objects and embodiments are set forth in the following description and illustrated in the drawings described hereinbelow.

DETAILED DESCRIPTION OF THE PREFERRED EMBODIMENT

When performing the process for manufacturing protective helmets as described in this invention, there generally is no limitation with respect to the materials used other than that the materials are capable of being used to make protective helmets in an insert-molding process. In a preferred embodiment, the materials employed in this invention will meet all performance requirements of all regulated safety requirements existing at the time of manufacture.

Figure 1:
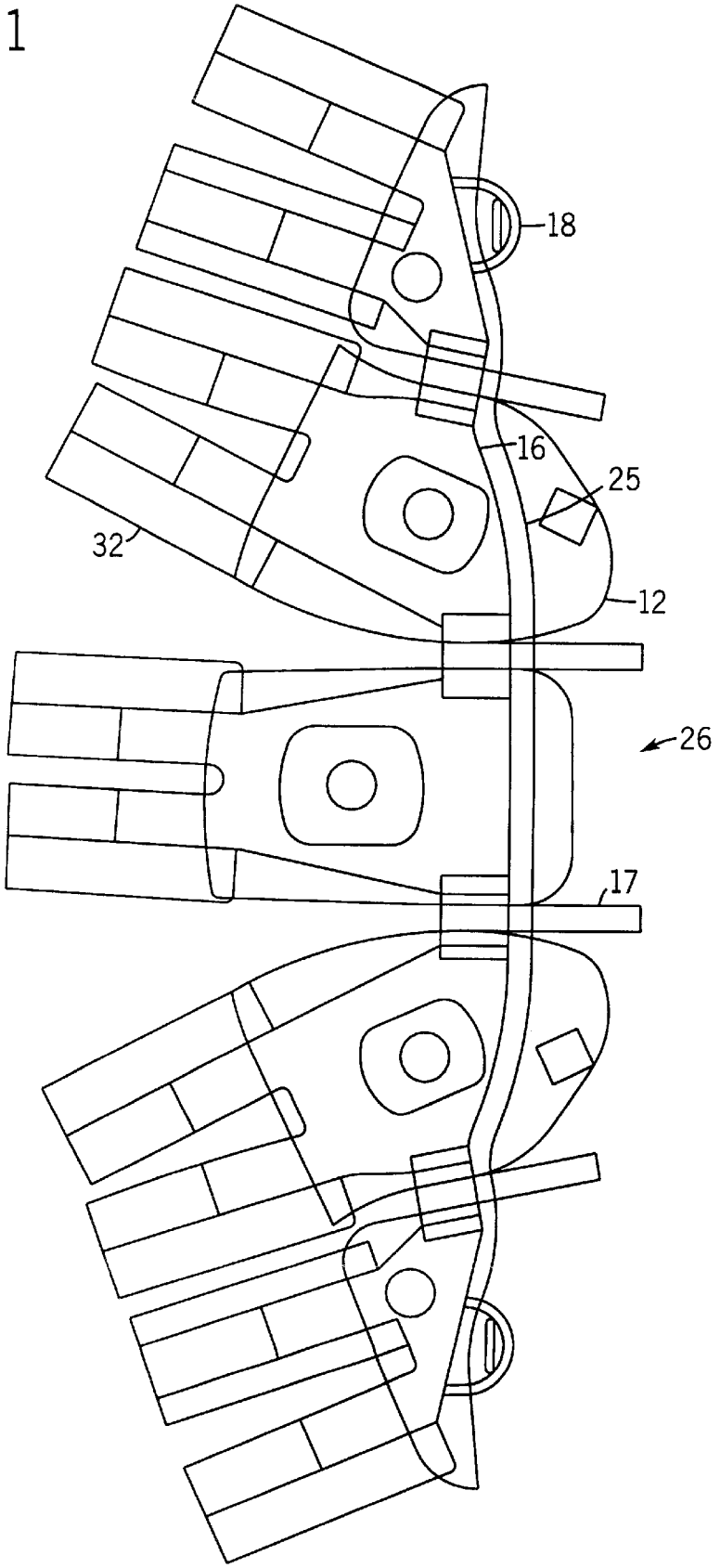
FIG. 1 is a plan view of an unfolded armature that can be used in this invention.
Figure 2:
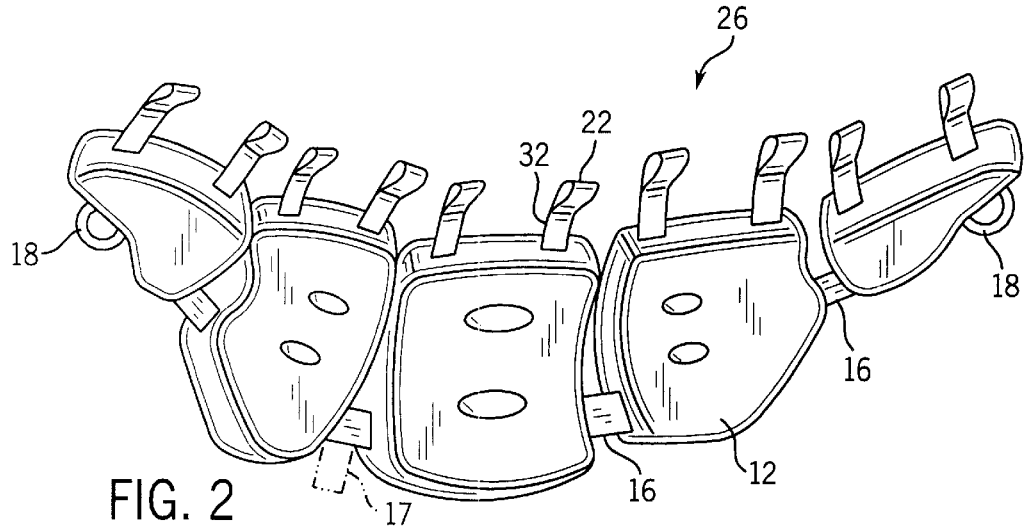
FIG. 2 is a view of a peripheral panel assembly making up a portion of a helmet.

FIG. 1 is a plan view of a one-piece armature 16 that can be used in this invention. The invention comprises the step of insert molding such an armature 16 into a protective helmet 10. More particularly, the armature 16 is placed into a mold and a polymer, such as expandable polystyrene, is injected into the mold to create a final part in the shape of each of a plurality of peripheral panels 12, resulting in the armature 16 being embedded within a peripheral panel assembly 26 to form a back portion and side portions of the helmet 10 (see FIG. 2). The one-piece armature 16 eliminates the need for a plethora of smaller connectors to link all of the panels 12, thereby simplifying the manufacturing process. In addition, use of the one-piece armature 16 provides added uniformity in hinging the panels 12 to one another and uniformity in over-all sizing and fit of the helmet 10.

A second mold is then used to create at least one top panel 14 by injecting a polymer, such as expandable polystyrene, into the mold. An alternate embodiment of the present invention includes the step of placing a second armature (not shown) into the second mold before injecting the polymer. The at least one top panel 14 is then secured to the peripheral panel assembly 26.

In another embodiment, after placing the armature 16 into a mold and injecting the polymer into the mold to create a peripheral panel assembly 26 to form a back portion and side portions of the helmet 10, extensions of the armature 16 can be placed into a second mold and the at least one top panel 14 can then be insert-molded to the peripheral panel assembly 26.

Typical polymers suitable for this process include expanded polystyrene (EPS) made by BASF, HCC, Polysource, and Arco; expanded polypropylene (EPP) made by Kaneca, BASF, and Arco; expanded copolymers such as GECET (a PPO material) made by HCC; and expanded polyethylene (EPE) made by Arco.

As mentioned above, the armature material is generally not limited to, but preferably is, a material selected from the group consisting of polyacrylates, polyamides and polyesters. In a most preferred embodiment, the armature 16 is a non-stretch, flexible, porous material made of spun polyester fibers woven into mesh and coated with polymerizable vinyl groups, such as polyvinylchloride (PVC), or polyurethane. The polymer having polymerizable vinyl groups is often a polyvinylhalide with polyvinylchloride being the most preferred. Alternatively, the armature 16 could be a polymer die-cut from plastic sheet stock, or the armature 16 could be molded to a desired shape.

The material used to make the armature 16 in this invention may be prepared by art-recognized techniques which include, for example, free radical polymerizations of the respective monomeric units used to make the armature material. Also, the armature material is commercially available in the form of rolls from Snyder Manufacturing.

The rolls of material used to make the armature 16 are cut into shapes that may be used in the process for making the helmets of this invention. The material used to make the armature 16 may be cut by various means, including with a hand-held cutting device such as a utility knife or scissors or using a waterjet cutter. Preferably, however, the material used to make the armature 16 is cut with a die cutter or punching tool.

Figure 3:
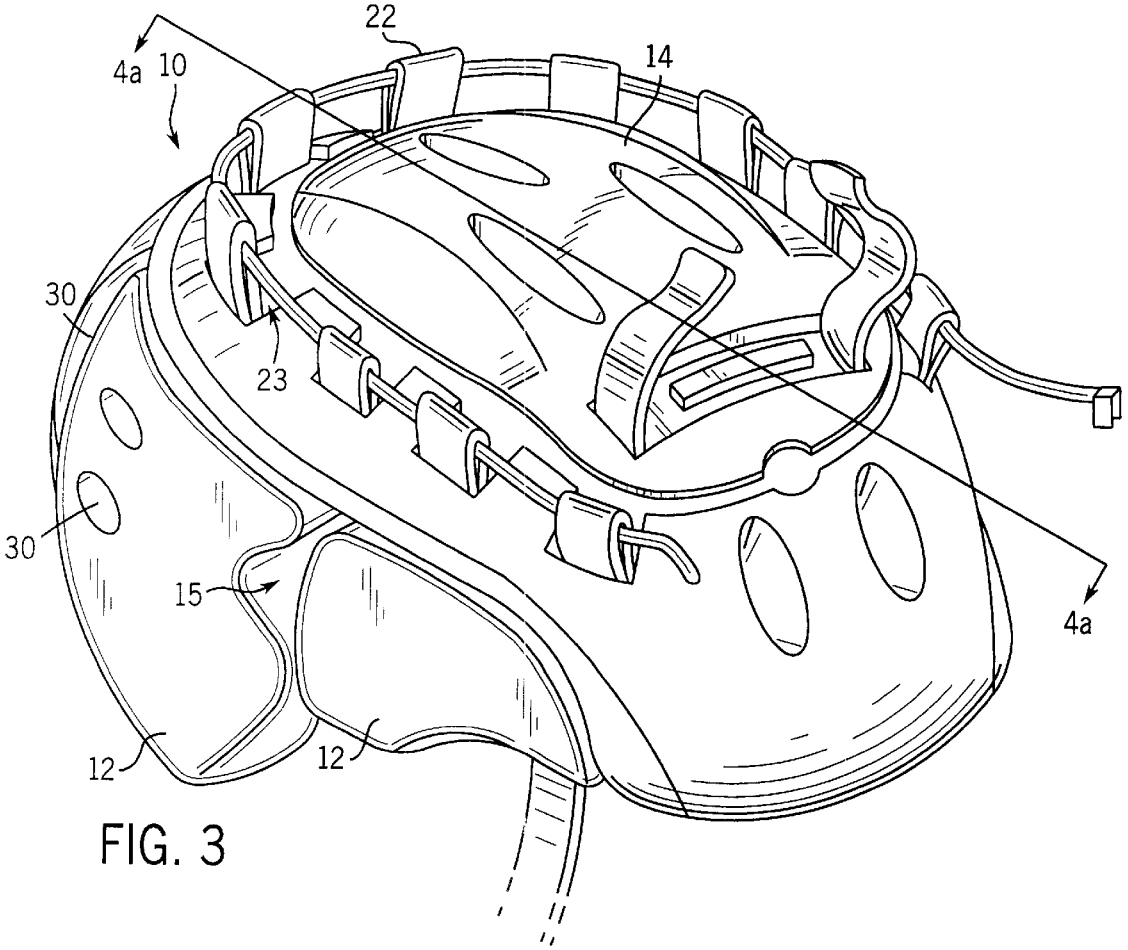
FIG. 3 is a perspective view of an assembled helmet, showing attachment of a top panel to a peripheral panel assembly.

FIG. 3 shows the peripheral panel assembly 26 during assembly prior to attachment to the top panel 14. Since the armature 16 is discontinuous at the top, tabs 32 from the armature 16 extend upward from the peripheral panels 12, forming attachment loops 22. These tabs 32 are preferably folded lengthwise first and then sewn to form the attachment loops 22 for added strength prior to attaching the top panel 14 to the peripheral panels 12. The attachment loops 22 of the armature 16 are inserted through assembly slots of the top panel 14 to attach the peripheral panel assembly 26 to the top panel 14. A gasket (not shown) is secured between the peripheral panel assembly 26 and the top panel 14, for purposes of buffering the panels 12 and 14. The gasket is a roll of open-cell foam with adhesive on one side, cut to length and inserted between the peripheral panel assembly 26 and the top panel 14. Alternatively, the gasket is formed by resin foamed and extruded into sheet stock to which pressure sensitive adhesive is applied and the gasket is die cut or molded into final shape. A strap or tie wrap 23, or the equivalent thereof, can then be fed through the attachment loops 22, tightened and fastened, using a buckle for example, and cut to size, as a further measure of securing the top panel 14 to the peripheral panel assembly 26. In the alternate embodiment comprising a second armature (not shown) molded within the top panel 14, the top panel 14 can be secured to the peripheral panel assembly 26 by attaching the first and second armatures 16 to one another. Reinforcement limiter tabs 17 (shown in FIG. 1) can also be sewn to the armature 16 where the peripheral panels 12 are joined. The tabs 17 provide additional strength. Chinstrap hangers 18 can be attached to, or protrude from, the armature 16 for added conformity of the helmet 10 to the wearer's head. The tabs 17 and the chinstrap hangers 18 can be sewn to the armature 16 either before or after the armature 16 is insert molded. A strip of webbing 25 can be sewn to a bottom edge of the armature 16 between the chinstrap hangers 18 and through the tabs 17 for added reinforcement. The webbing 25 preferably comprises a nylon woven product.

In another alternate embodiment (not shown), the top panel 14 can be secured to the peripheral panels 12 using alternative connectors, such as plug-in style hardware, in lieu of attachment loops 22.

The plurality of the panels 12 and 14 allows the helmet 10 to self-adjust and conform to the shape of the wearer's head due to the flexibility of the armature 16. The plurality of panels 12 and 14 also limits the spread between the panels 12 and 14. In a preferred embodiment, the peripheral panels 12 comprise at least two panels 12 on each side of the wearer's head and a peripheral panel 12 at the back of the wearer's head, for a total of at least five peripheral panels 12 attached to the top panel 14. In this preferred embodiment, two panels, the top panel 14 and a peripheral panel 12 at the back of the wearer's neck, are disposed from the wearer's forehead to the wearer's neck. The plurality of peripheral panels 12 provides conformity to the shape of the wearer's head such that merely one top panel 14 is sufficient, although more than one top panel 14 may be used. Since the armature 16 connects the peripheral panels 12 to one another, self-adjustment occurs in horizontal directions. The connection of the peripheral panels 12 to the top panel 14 provides outward pivoting motion and additional stability of the panels 12 and 14 against twisting and shear motions. This conformity to the wearer's head provides extraordinary comfort as well as safety. In a crash or other contact with the helmet 10, the initial impact wherein the helmet 10 comes in contact with a surface can be less damaging to a helmet wearer compared to secondary impact wherein the wearer's head hits the inside of the helmet 10. By conforming to the wearer's head so closely, the helmet 10 made by the process of this invention provides exceptional safety in terms of lessening secondary impact. Furthermore, the conformity of the helmet 10 to the wearer's head eliminates the need for sizing pads typically required to make helmets fit the wearer's head. Sizing pads in the prior art are typically inserted into pockets or attached with an adhesive around the internal brim of helmets to ease discomfort and reduce some misfit in helmets. The maximum size of the helmet 10 is dependent on the size of the armature 16, which should be large enough to allow the helmet 10 to fit virtually all adult wearers' heads in general, while the flexibility of the armature 16 allows the helmet 10 to conform to practically all head shapes. A somewhat smaller version is available for children and exhibits all the advantages of an adult form of the helmet 10.

Furthermore, in a preferred embodiment of the invention, vents 30 can be molded between some of the panels 12 and 14 in order to prevent the wearer from overheating during warm weather or during strenuous physical exertion. Additional vents 30 can be molded within the panels 12 and 14 to provide additional means to combat overheating. Ideally, the armature 16 is large enough and flexible enough to allow adequate room beneath the helmet 10 for a person to wear a cap beneath the helmet 10 for enhanced protection from the cold as well. Again, the versatility and goodness of fit enable a wearer to use the helmet 10 with a cap or other head covering without need to add different sizing pads or the like for different seasons or conditions of wear.

In a preferred embodiment of the invention, the top panel 14 is formed to overlap gaps 15 between the top panel 14 and the peripheral panels 12, thereby protecting the wearer's head from leakage of substances onto the wearer's head. Also in a preferred embodiment, the gaps 15 between the panels 12 and 14 are staggered to prevent unwanted folding or other instability and to enhance the integrity of fit of the helmet 10.

Additionally, a decorative shell 76 (see FIG. 8) may be attached to the top panel 14 and peripheral panel assembly 26. The process for making the shell 76 comprises extruding clear or colored resin pellets into sheets, vacuum forming the sheets over molds to provide overall shape, cutting the final shell shape out of formed blank, and trimming vent holes 30. Various manual or automated methods can be used for trimming vent holes 30. Such methods include using a hot knife or routers, grinding, cutting, and shearing.

Figure 4A:
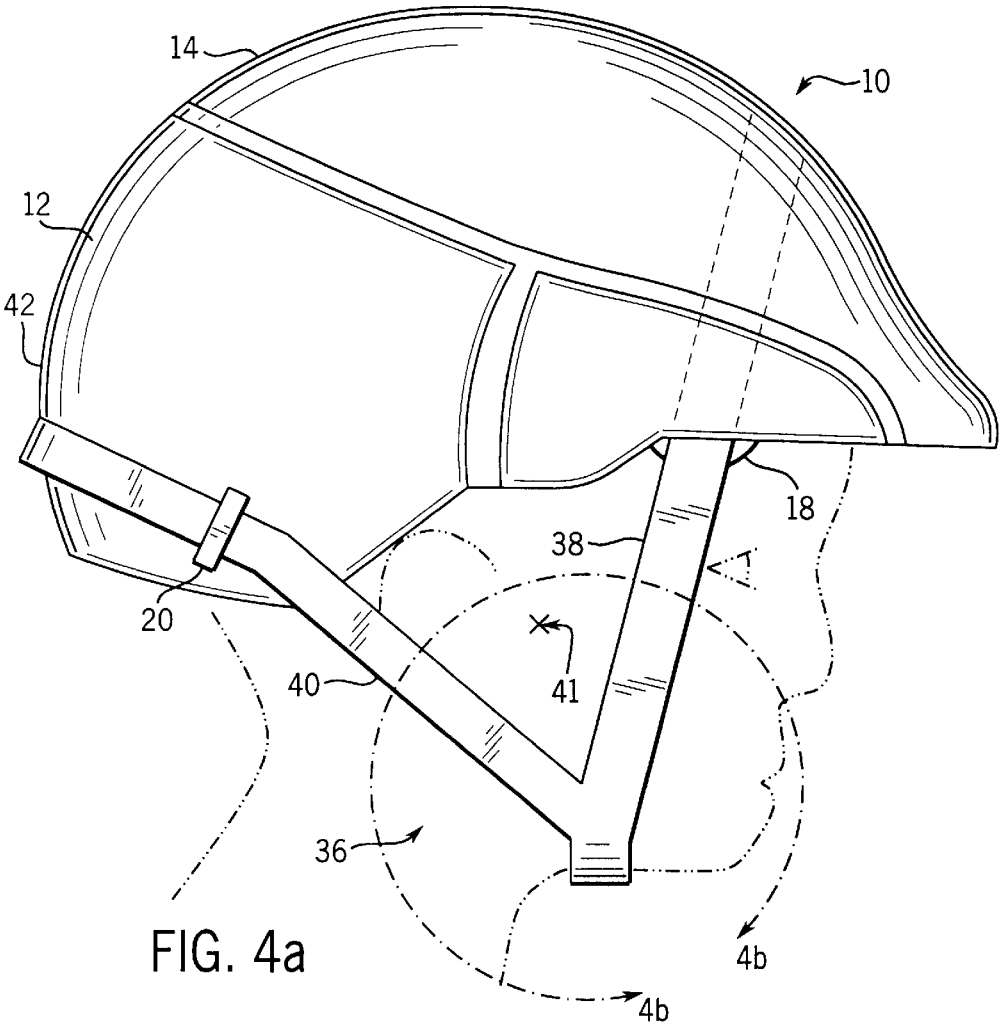
FIG. 4*a* is a longitudinal view, taken along line 4*a*—4*a* of FIG. 3, of a helmet.

FIG. 4*a* is a longitudinal view, taken along line 4*a*—4*a* of FIG. 3, of the preferred form of the helmet 10, demonstrating the location of a retention system 36. The retention system 36 features a chinstrap 38 and a nape strap 40 made of, for example, nylon or polyester. The left and right sides of the chinstrap 38 are routed through the top panel 14 (see dashed lines) for strength. The chinstrap 38 can be coupled to the front, central area or back of the top segment 14 of the helmet 10. The nape strap 40 is preferably attached to an exterior surface 42 of the rear peripheral panels 12 to provide stability and fit. The chinstrap hangers 18 and nape strap guides 20 can be attached to either the exterior surface 42 of the helmet 10 or to the armature 16. In a preferred method of manufacture, the chinstrap hangers 18 and the nape strap guides 20 comprise pellets which have been injected into molds for achieving their final shape. The chinstrap hangers 18 and the nape strap guides 20 can also be manufactured by injection molding, die cutting or thermoforming processes. By securing the straps 38 and 40 in the manner shown and described, both horizontal and vertical stabilization is achieved when the helmet 10 is secured to the wearer's head.

Figure 4B:
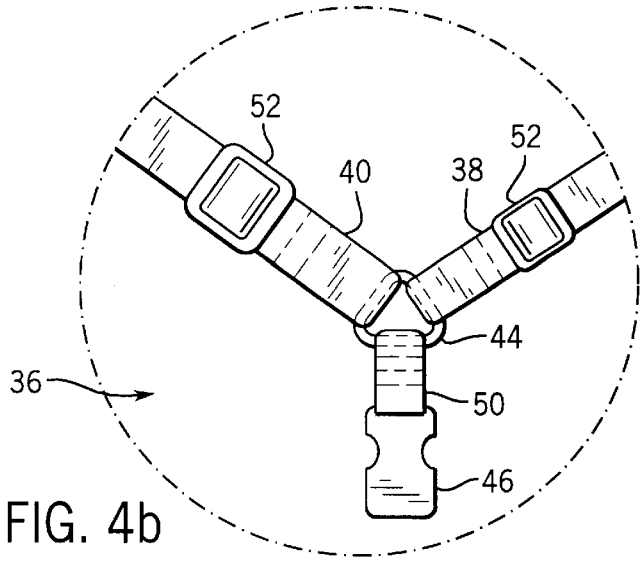
FIG. 4*b* is a partial detailed view of a retention system of the helmet of FIG. 4*a;*

FIG. 4*b* is a partial detailed view of the retention system 36 of the helmet 10 of FIG. 4*a*. The straps 38 and 40 are joined at a ring 44, preferably a triangular ring 44, to draw them inward against the wearer's head when they are tensioned. The triangular ring 44 is then attached to a buckle 46 with a short loop of strapping 50. Both the chinstrap 38 and the nape strap 40 are allowed to slide around the triangular ring 44 to adjust their lengths. The ends of the straps 38 and 40 are then terminated at slide adjusters 52, such as Tri-glides™ a trademark of Nexus Corporation, located on each of the respective straps 38 and 40.

If not secured, helmets in general have a natural tendency to rotate on a wearer's head about a virtual pivot point 41. To prevent forward rotation of the helmet 10 of this invention, the nape strap 40 is fixed from the rear of the helmet 10 to the wearer's jaw at a distance far away from the pivot point 41 (see FIG. 4*a*). An ideal retention system 36 provides excellent stability and can accommodate some amount of slack in the straps 38 and 40 since large amounts of slack are required for the helmet 10 to rotate a significant amount. Fixing the chinstrap loop 50 at a relatively short length provides good forward and rearward roll resistance. The short, fixed-length chinstrap loop 50 also maintains the pivot point 41 in an area central to the chinstrap 38 and the nape strap 40 rather than directly on or in close proximity to either of the straps 38 and 40. In a typical helmet retention system, there are approximately six adjustment points or degrees of freedom, each controlled by the user which can lead to poor locations of the straps resulting in poor stability. A preferred embodiment of the retention system 36 of the present invention having a short, fixed-length chinstrap loop 50 has only two points of adjustment, namely the nape strap 40 and the chinstrap 38. Hence the potential for a wearer to place the straps 38 and 40 in a poor location is highly limited. The only foreseeable misuse of the retention system 36 would be caused by a wearer leaving large amounts of slack in the nape strap 40 or chinstrap 38, or not even fastening the buckle 46. In both of these cases, the helmet 10 will not be fitted properly to the wearer, making the wearer aware that something needs to be corrected. This configuration creates pivot axes substantially between horizontal and vertical, thereby enhancing flexibility, and thus fit, of the panels 12 and 14 around the wearer's head. The retention system 36 is self-adjusting in that securing the retention system 36 to the head simultaneously pulls the peripheral panels 12 against the wearer's head and adjusts the fit of the helmet 10.

The placement and location of the chinstrap 38 on a child's head is a factor often overlooked by many major helmet manufacturers. The mandible or jaw of the child develops rapidly over the initial years from a small recessed bone to the large prominent bone found in adults. This requires the chinstrap 38 to be located much further back and at an inclined orientation to the skull to achieve good stability for protective purposes as well as for comfort. The location of the retention system 36 on the helmet 10 lends itself very well to providing good fit and stability over a large age range.

A safe, comfortable form of the helmet 10 is provided by the invention for children that will also expand along with the child's head. The child's model of the helmet 10 is a cost-effective alternative for parents who would otherwise have to replace their child's helmet 10 progressively as the child's head grows. In terms of helmet design, in an alternate embodiment, a toddler's helmet can include softer and thicker walls of the peripheral panel assembly 26 in view of the presumed lower impact tolerance and lighter weight of a toddler's head. This is accomplished by providing the softer, thicker walls of the peripheral panel assembly 26 in an interior shape similar to human heads, and meeting the stability requirements of regulated bicycle helmet safety standards.

Figure 5A:
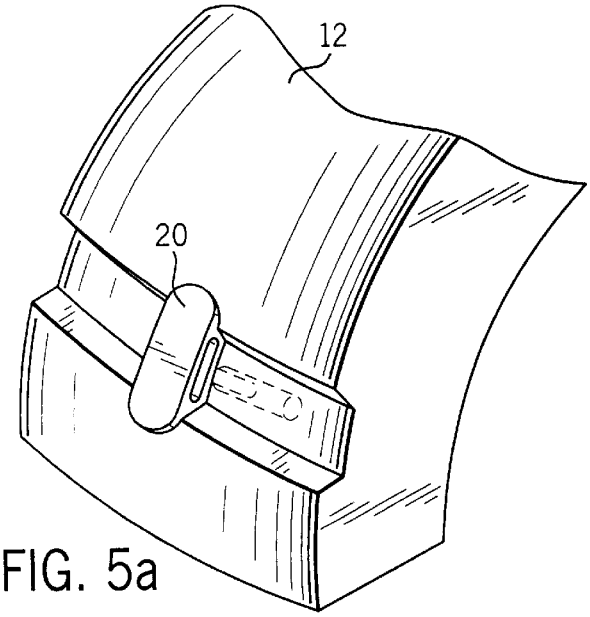
FIGS. 5*a*, 5*b*, 5*c* and 5*d* are partial oblique views of a peripheral panel of the helmet of FIG. 3 showing an interior receptacle and an exterior receptacle for a strap guide.
Figure 5B:
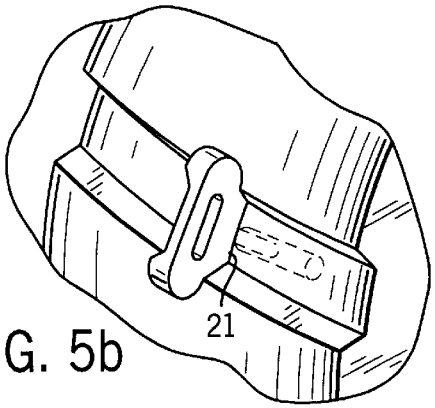
Figure 5C:
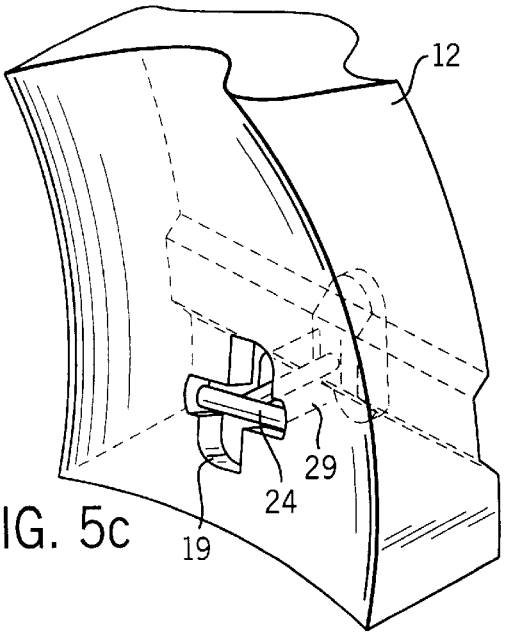
Figure 5D:
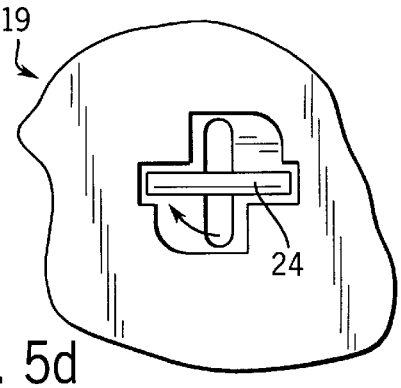

FIGS. 5*a* and 5*b* are partial oblique views of a preferred form of one of the peripheral panels 12 showing an exterior receptacle 21 for the improved strap guide 20. FIGS. 5*c* and 5*d* are partial oblique views of a preferred form of one of the peripheral panels 12 showing an interior receptacle 19 for the improved strap guide 20. The strap guide 20 consists of a single part tab 24 constructed of a soft thermoplastic (low density polyethylene, polyurethane, thermoplastic elastomer or thermoplastic resin) and is inserted into a slot 29 (see FIG. 5*c*) molded into the peripheral panels 12. The tab 24 is locked into place with one end of the tab 24 inserted into the slot 29 in the peripheral panels 12 until the tab 24 is exposed inside the helmet 10 and then twisted ninety degrees to its locked position (see FIG. 5*d*). A sharp edge under the tab 24 and a recess forming the exterior receptacle 21 provide for semi-permanent attachment of the strap guide 20 to the helmet 10. The tab 24 can be locked from the side with a protrusion in the exterior receptacle 21 which must be overridden by the tab 24 when twisted into the locked position. The locked position of the tab 24 corresponds to its initial shape before insertion, thereby requiring manual intervention to unlock the mechanism since it will not unwind during normal use. Access to the tab 24 can be limited by keeping the interior receptacle 19 small enough to prevent fingers from reaching the tab 24 or by covering the interior receptacle 19 with a comfort pad. The flexibility of the tab 24 allows the tab 24 to buckle and collapse under impact, however, the tab 24 is sufficiently strong to prevent it from being pulled out by the wearer during normal use.

Figure 6:
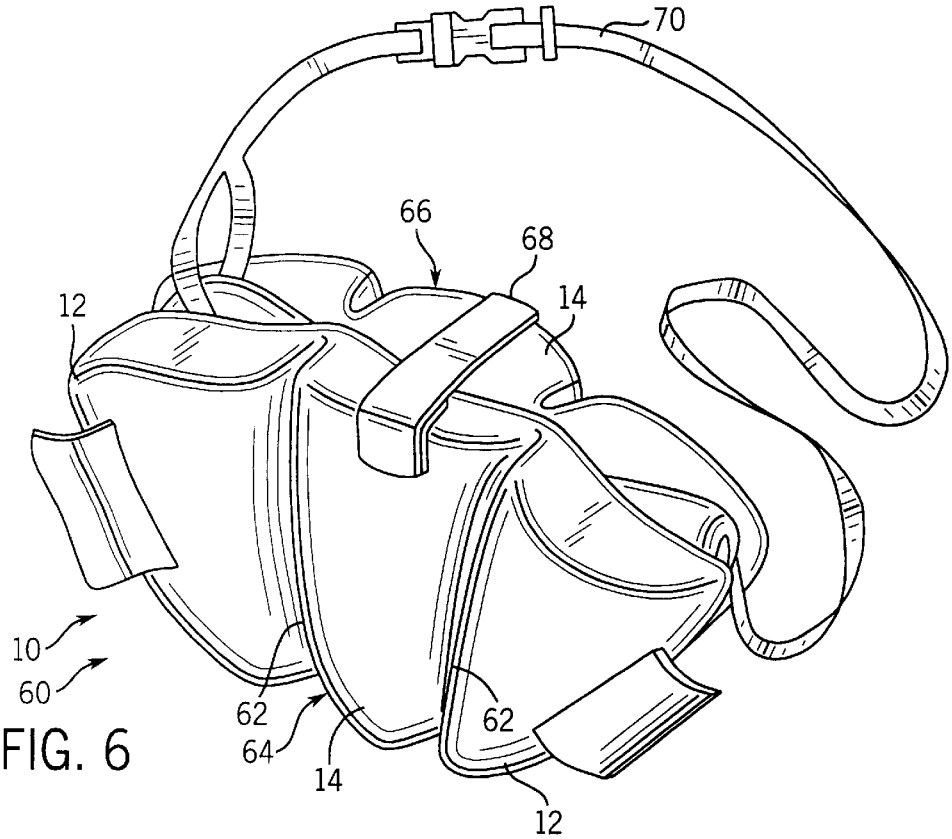
FIG. 6 is a perspective view of an alternate embodiment of a helmet in a pouch mode.

FIG. 6 shows an alternate embodiment and use of the helmet 10 resulting from this invention, wherein the helmet 10 can be folded in such a way as to convert the helmet 10 into an article-carrying pouch 60. In this embodiment, the helmet 10 can comprise two top panels 14 and a plurality of circumferentially-spaced, generally radial, fold lines 62 emanating from the center of the top of the helmet 10. The fold lines 62 include aligned fold lines 62 running over both sides of the top panels 14 facilitating folding of the helmet 10 about the aligned transverse fold lines 62. Foldable front and rear halves 64 and 66 of the top of the helmet 10 define, between them, an article-carrying pouch cavity. A fastener 68 is attached to the front and rear halves 64 and 66 for latching the front and rear halves 64 and 66 together to hold articles placed therein. The fastener 68 can comprise a variety of different types of fasteners, including Velcro™, snaps, or a zipper. A belt and shoulder strap system 70 of adjustable length can be attached to the helmet 10, allowing the combined helmet 10 and the pouch 60 to be suspended from the shoulder of the wearer or worn as a belt strapped about the waist of the wearer. By converting the helmet 10 into the pouch 60, the wearer need not carry around a cumbersome helmet, and furthermore can carry such items as gloves or sunglasses in the pouch 60. For folding purposes, the preferred number of total panels 12 and 14 is six, but a higher number is still quite feasible.

Figure 7:
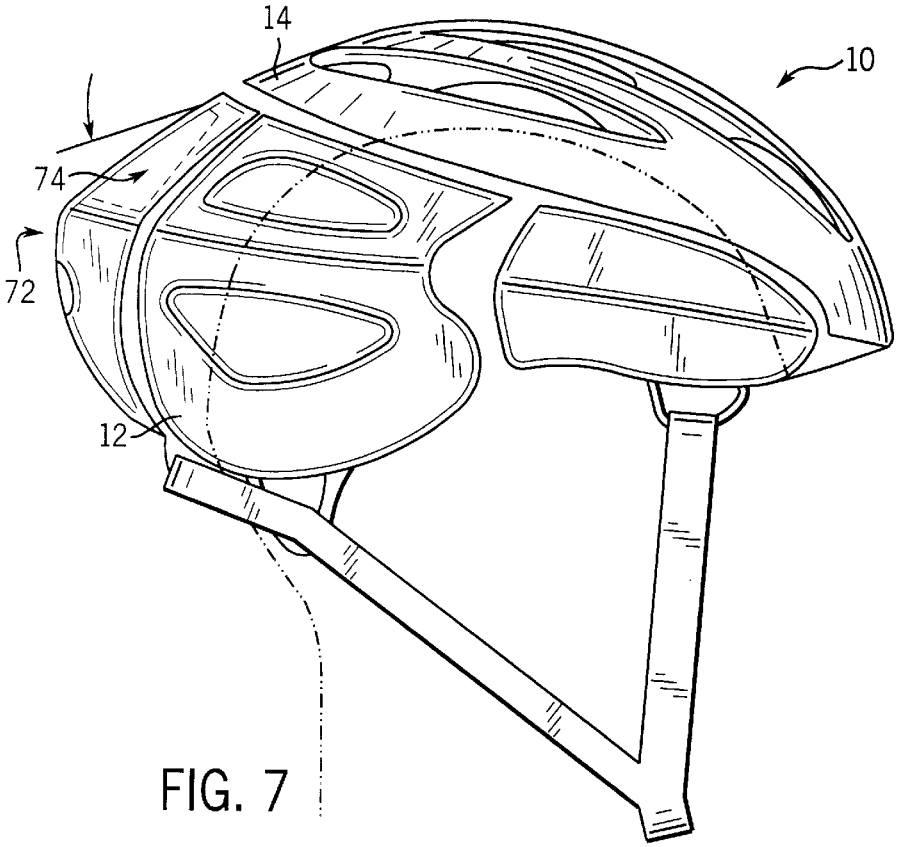
FIG. 7 is a right side view of a helmet having a protrusion at the back of the helmet.

FIG. 7 is a right side view of another embodiment of a helmet resulting from this invention comprising the formation of a protrusion 72 at the back of the helmet 10 wherein the protrusion 72 can accommodate a storage compartment 74. This protrusion 72, and the storage compartment 74 within the protrusion 72, can be molded as part of a peripheral panel 12 during the insert molding of the peripheral panel assembly 26. Because of the geometry of the helmet 10, particularly the concept of the peripheral panels 12 attached to the top panel 14, the helmet 10 would not be thrown off balance with the addition of the protrusion 72 the way typical helmets would be. The compartment 74 in the protrusion 72 could be used for many purposes, including holding a satellite navigation system, telephone system, homing device, keys, money or numerous other items.

Figure 8:
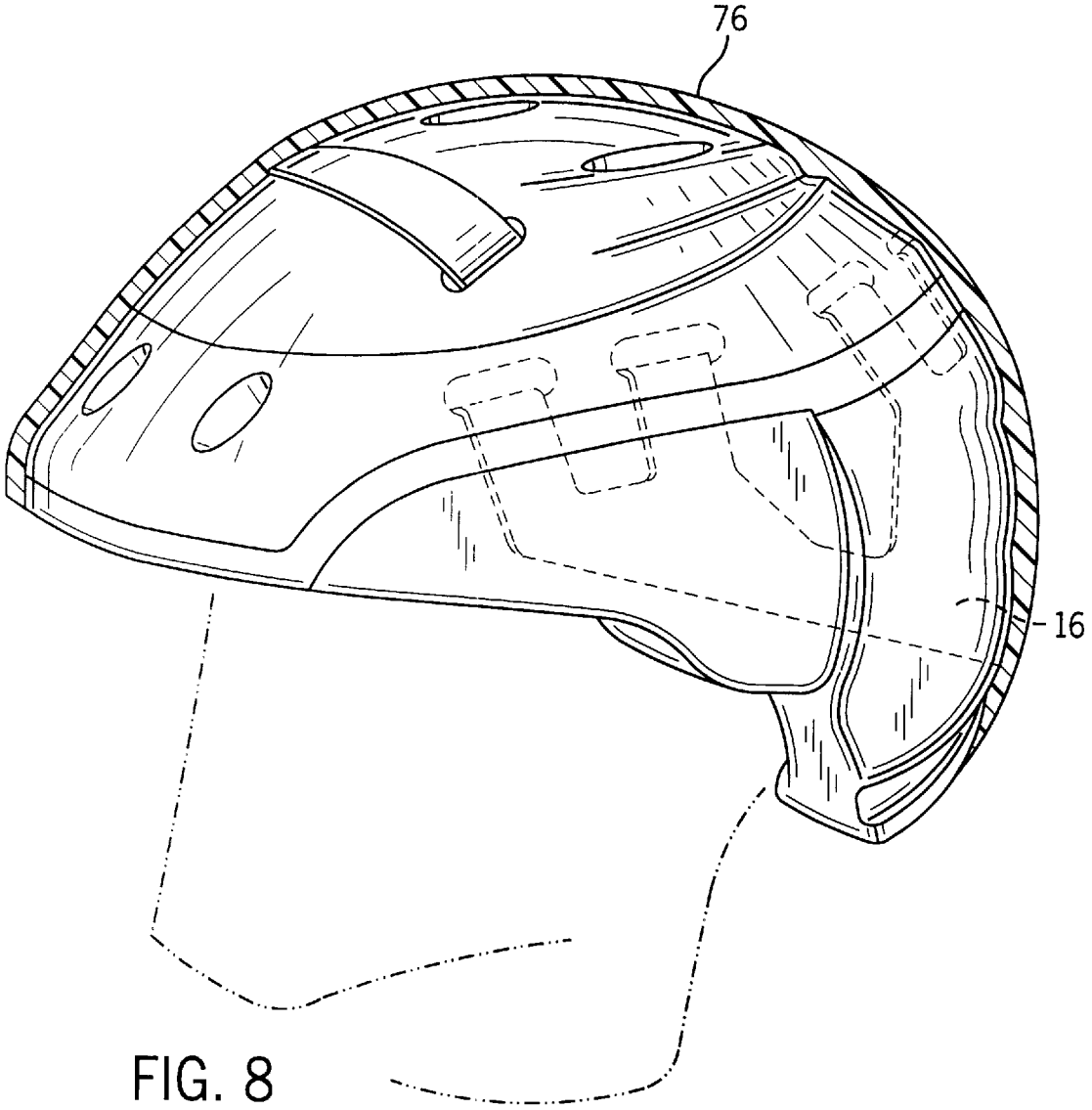
FIG. 8 is a longitudinal section view of a helmet showing one all-encompassing exterior shell with an armature insert-molded within the helmet.

FIG. 8 is a view of another alternate embodiment of a helmet resulting from this invention showing one all-encompassing exterior shell 76 (in cross-section) in which the armature 16 is insert-molded to provide a contoured fit to the wearer's head.

While preferred embodiments have been shown and described, it should be understood that changes and modifications can be made therein without departing from the invention in its broader aspects. Various features of the invention are defined in the following claims.

What is claimed is:

1. A process for making a helmet comprising the steps of:

a. placing a one-piece armature into a first mold;

b. injecting a polymer into the first mold to create a peripheral panel assembly comprising, segmented peripheral panels that conform in shape to a wearer's heads, the panel assembly forming a back portion and side portions of the helmet;

c. injecting a polymer into a second mold to create at least one top panel having assembly slots;

d. attaching the at least one top panel to the peripheral panel assembly; and e. attaching a retention system assembly to at least one of the armature, the peripheral panel assembly and the top panel.

2. The process of claim 1 further comprising the steps of:

a. vacuum forming sheets of extruded resin pellets to form a shell to fit over the at least one top panel; and b. attaching the shell to the at least one top panel.

3. The process of claim 1 wherein the armature comprises spun polyester fibers coated with polyvinyl chloride and is die-cut to shape.

4. The process of claim 1 wherein the armature is coated with polyurethane.

5. The process of claim 1 wherein the peripheral panel assembly comprises five peripheral panels.

6. The process of claim 1 further comprising the steps of a. placing extensions of the armature into a mold; and b. insert-molding the at least one top panel to the peripheral panel assembly.

7. The process of claim 1 further comprising the step of molding a protrusion extending from a back side of the helmet and forming a compartment within the protrusion.

8. The process of claim 1 wherein the polymer comprises expandable polystyrene.

9. The process of claim 1 further comprising the step of folding extensions of the armature and securing the folded extensions in such a way as to form attachment loops.

10. The process of claim 9 further comprising the steps of:

a. attaching a gasket to the at least one top panel; and b. inserting the attachment loops of the armature through the assembly slots of the at least one top panel to attach the peripheral panel assembly to the at least one top panel, with the gasket between the peripheral panel assembly and the at least one top panel.

11. The process of claim 10 further comprising the steps of:

a. feeding a tie wrap through the attachment loops;

b. tightening the tie wrap; and c. cutting the tie wrap to size.

12. The process of claim 10 further comprising the steps of:

a. feeding a strap having two ends through the attachment loops;

b. attaching a first end of the strap to a second end of the strap with a buckle;

c. tightening the strap and securing the buckle; and d. securing a loose end of the strap by applying an adhesive to the strap and to the loose end of the strap.

13. The process of claim 1 further comprising the step of forming at least one strap guide on the peripheral panel assembly wherein the at least one strap guide comprises:

a one-piece tab;

an interior receptacle molded into the helmet; and an exterior receptacle molded into the helmet, wherein the tab is inserted through one of the interior and exterior receptacles until the tab is exposed through the other of the interior and exterior receptacles, then the tab is twisted into a locked position.

14. The process of claim 13 further comprising the step of forming a protrusion within the interior receptacle for preventing further twisting of the tab.

15. The process of claim 13 further comprising the steps of:

a. inserting a chinstrap assembly through two of the assembly slots;

b. feeding a nape strap through the strap guides on the peripheral panel assembly;

c. joining the chinstrap and the nape strap with at least one ring; and d. attaching the at least one ring to a buckle with a short length of strap.

16. The process of claim 15 wherein the chinstrap assembly comprises two straps, the process further comprising the step of securing a first of the two straps to a second of the two straps once the two straps are inserted through the assembly slots.

17. The process of claim 15 wherein the at least one ring is triangular.

18. The process of claim 1 wherein the retention system assembly comprises:

a. a chinstrap having a left side and a right side;

b. a nape strap;

c. at least one tensioning guide;

d. at least one ring; and e. at least one buckle.

19. The process of claim 18 further comprising the steps of:

a. feeding a first end of the nape strap through the strap guides;

b. feeding the first end of the nape strap through the at least one tensioning guide;

c. feeding the first end of the nape strap through the at least one ring; and d. sewing the first end of the nape strap around the at least one tensioning guide.

20. The process of claim 1 wherein the helmet further comprises an article-carrying pouch cavity formed by folding the helmet.

21. The process of claim 20 wherein the helmet further comprises means for attaching the helmet about a wearer's waist.

22. The process of claim 20 wherein the helmet further comprises means for carrying the helmet suspended from a wearer's shoulder.

23. The process of claim 20 further comprising the step of attaching a latch to a first side of the helmet and to a second side of the helmet in order to maintain the pouch cavity.

24. A process for making a helmet comprising the steps of:

a. placing a first one-piece armature into a first mold;

b. injecting a polymer into the first mold to create a peripheral panel assembly comprising segmented peripheral panels that conform in shape to a wearer's head, the panel assembly forming a back portion and side portions of the helmet;

c. placing a second armature into a second mold;

d. injecting a polymer into the second mold to create at least one top panel having assembly slots;

e. attaching the at least one top panel to the peripheral panel assembly; and f. attaching a retention system assembly to at least one of the armature, the peripheral panel assembly and the top panel.

25. The process of claim 24 wherein the polymer comprises expandable polystyrene.

* * * * *

UNITED STATES PATENT AND TRADEMARK OFFICE

CERTIFICATE OF CORRECTION

PATENT NO. : 6,159,324
DATED : December 12, 2000
INVENTOR(S) : Watters et al.

It is certified that error appears in the above-identified patent and that said Letters Patent is hereby corrected as shown below:

Column 10,
Line 25, after "comprising" the comma should be deleted.
Line 27, "heads" should be -- head --.

Signed and Sealed this

Second Day of October, 2001

*Attest:*

Nicholas P. Godici

NICHOLAS P. GODICI
*Acting Director of the United States Patent and Trademark Office*

*Attesting Officer*